United States Patent [19]

Kurzrock et al.

[11] 4,408,957

[45] Oct. 11, 1983

[54] SUPERSONIC BLADING

[75] Inventors: John W. Kurzrock; Peter C. Tramm, both of Indianapolis, Ind.

[73] Assignee: General Motors Corporation, Detroit, Mich.

[21] Appl. No.: 227,795

[22] Filed: Feb. 22, 1972

[51] Int. Cl.[3] ..... F01D 5/14

[52] U.S. Cl. ..... 416/237; 416/223 A; 415/181

[58] Field of Search ..... 416/237, 175, 225, 233, 416/243; 415/181; 137/15.1

[56] References Cited

U.S. PATENT DOCUMENTS

| | | | |
|---|---|---|---|
| 2,435,236 | 2/1948 | Redding | 416/237 |
| 2,966,028 | 12/1960 | Johnson et al. | 137/15.1 |
| 2,971,330 | 2/1961 | Clark | 137/15.1 |
| 2,974,927 | 3/1961 | Johnson | 415/199 |
| 3,059,834 | 10/1962 | Hausammann | 416/237 |

*Primary Examiner*—Stephen C. Bentley
*Attorney, Agent, or Firm*—Paul Fitzpatrick

[57] ABSTRACT

Supersonic rotor blading in an axial-flow fan or compressor employs blades such that shock waves originating on a blade are canceled at the intersection of the wave and the surface of an adjacent blade by virtue of a blade configuration such that the shocks intersect the blade surface at a line of properly oriented change in flow angle of the blade surface. A three-wave system is employed.

6 Claims, 5 Drawing Figures

SUPERSONIC BLADING

The invention described and claimed herein was made in the course of work under a contract with the Department of Defense.

Our invention is directed to supersonic blade cascades, and particularly to compressor blade cascades which form a rotor section or part of a rotor section of an axial-flow or mixed-flow compressor or fan.

The principal object of our invention is to improve the efficiency and the uniformity of exit conditions of a supersonic fan rotor or other supersonic blade cascade. An object is to obtain a predetermined static pressure ratio and exit flow angle by the use of a three-wave system.

The basic principle of our invention lies in so configuring the blades that compression or expansion waves originating on a face of a blade, as well as shock waves originating at the leading or trailing edge of a blade, intersect the surface of an adjacent blade along a line of change in direction of the surface of the adjacent blade such that the incident wave is canceled, or at the trailing edge of the adjacent blade with the same result. Particularly, in its preferred embodiment, the invention involves a three-wave system for control of supersonic flow through a blade cascade.

It will be understood that our invention relates to supersonic flow cascades, although it may be employed in rotor stages in which flow is supersonic only over part of the blade span, the blade profile according to the invention being blended into a subsonic type of blade profile toward the roots of the rotor blades in this case.

The nature of our invention and its advantages will be clear to those skilled in the art from the succeeding detailed description of preferred embodiments of the invention and the accompanying drawings.

Figure 1:
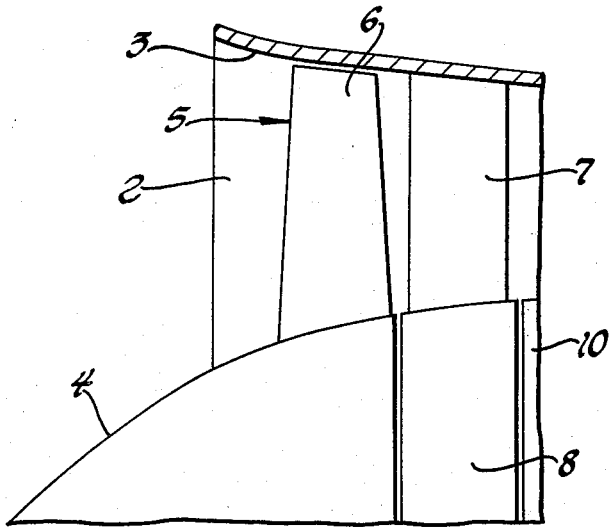
FIG. 1 is a schematic sectional view of a supersonic or transonic compressor inlet stage.

Referring first to FIG. 1, to illustrate one environment for application of the invention, there is shown schematically the entry portion of an axial-flow compressor or fan. The air entry 2 is defined between a case 3 and a nose cone or fairing 4. The fairing 4 is rotatable and forms a rotor body on which is mounted an annular row or cascade 5 of rotor blades 6. The discharge from the rotor blades flows through an annular cascade of stator vanes 7 extending from the case 3 to an annular bearing support 8 which supports the shaft (not shown) which drives the fan 4, 5 and which also provides the inner boundary of the flow path through the vane cascade 7. Such structures are well known and there is no need to enlarge upon them here. Any desired structure may be disposed downstream of vanes 7, including further rotor structure 10.

As indicated, the rotor cascade 5 forms the subject matter of our invention. Our invention is concerned only with the blade portion that has supersonic inlet relative flow and supersonic or subsonic exit relative flow. Primarily, the flow field at exit is supersonic, but the three-wave principle can generate subsonic flow by having the trailing edge shock wave a strong oblique shock wave or a normal shock wave which results in subsonic flow downstream of the third wave.

Figure 2:
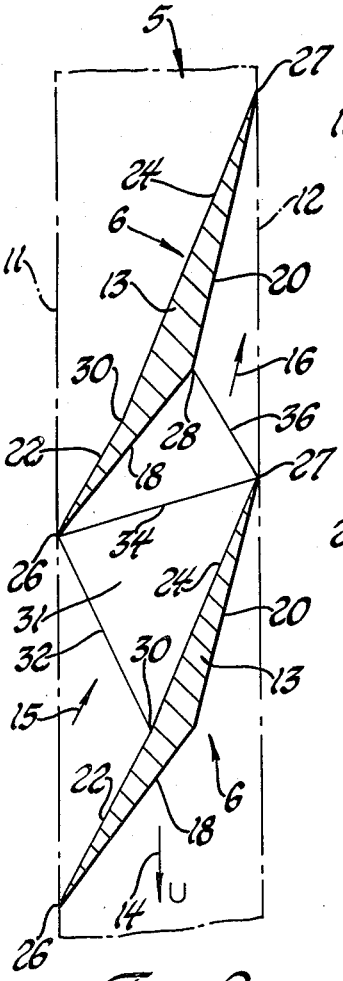
FIG. 2 is a diagram of a first type of blade cascade in which a compression wave is produced on the suction face of each blade and the leading edge shock wave of each blade is canceled at the trailing edge of the blade leading it.

Referring to FIG. 2, the forward and rearward boundaries of the annular blade cascade 5 are indicated by the broken lines 11 and 12 at the upstream and downstream or leading edge and trailing edge, boundaries respectively. In FIG. 2, two blades 6, indicated by numeral 13 in this species, are shown in cross section, which may be considered to be a typical section through a blade the cross section of which will normally vary spanwise of the blade. In FIG. 2 and in succeeding figures the blade cross section is shown as a trapezoidal figure, that is, one bounded by straight lines. This is an approximation adopted for illustrating the principles of the invention; the straight line segments illustrated may be regarded as an idealized case. In an actual compressor, the surfaces will be curved to some extent since influences such as area contractions usually exist through compressor rotor passages. Thus, the sides of the cross section may be curved, but they meet at points of relatively abrupt changes of direction at what may be termed "edges" on the blade.

The direction of rotation of the cascade is indicated by the arrow 14 and legend U in the figures, and the direction of air flow entering and leaving the cascade relative to the rotor is indicated by the arrows 15 and 16, respectively. The blade of FIG. 2 is defined by four surfaces indicated by line segments 18, 20, 22, and 24 in the cross section. Surfaces 18 and 22 meet at the leading edge 26 of the blade, and surfaces 20 and 24 meet at the trailing edge 27 of the blade. Surfaces 18 and 20 define the pressure face of the blade; that is, the face on which the higher pressure exists, which may also be termed the leading face, since it leads in the direction of rotation. Surfaces 22 and 24 define the suction or trailing face of the blade. With respect to direction of rotation, the lower blade illustrated in FIG. 2 may be considered as leading the upper blade in the figure and the upper blade of the figure as trailing the lower blade. Obviously, in an annular rotating cascade, each blade has a blade leading it and one trailing it in the cascade.

Surfaces 18 and 20 meet at an edge 28 and surfaces 22 and 24 at an edge 30. The term "edge" is employed as a term for the meeting lines of the faces as a term of convenience, as they are areas of relatively sharp curvature as compared to the relatively flat surfaces 18, 20, 22, and 24. However, the edges may be radiused to a desired extent (a desirable feature to extend the range of off-design conditions).

Two terms may be defined at this point; the pitch of the blades at any station along the span of the blades is the distance from a corresponding part of one blade in the cascade to the corresponding point on the next blade; as, for example, from the leading edge of one blade to the leading edge of the next. The term "stagger angle" as employed here refers to the angle made by a line joining the leading and trailing edges of a blade section with a plane containing the axis of rotation of the rotor.

The dimensions and form of the blade, the pitch, and the stagger angle must be properly related in order for the blade system to operate in accordance with the principles of our invention. These principles involve the employment of three successive waves which may be shock waves, compression waves, or expansion waves, which extend across each passage 31 between adjacent blades. Strong oblique or normal shock waves may exist for the trailing edge wave. In FIG. 2, the first of these waves is a compression wave 32 produced at the suction surface of the blade by the change in surface flow angle at the edge 30. The geometry of the cascade is so chosen that this compression wave intersects the leading edge 26 of the trailing blade. The second wave 34 is a shock wave generated by the leading edge 26 of the trailing blade as illustrated. The geometry is such that this shock wave intersects the leading blade at its trailing edge 27. This shock wave turns the air flow so that it is parallel with the pressure surface 18 of the trailing blade. The shock wave is canceled at the trailing edge 27 of the leading blade. The third wave 36 is the trailing edge shock wave of the leading blade. The geometry is such that this wave intersects the trailing blade at the edge 28 between the surfaces 18 and 20. The shock wave 36 is canceled by the turning of the blade pressure face at the edge 28 at which the wave 36 intersects this face to accord with the new direction of flow of the air. The flow field behind wave 36 is uniform, with a desired static pressure ratio and exit flow angle, this angle being indicated by arrow 16. This system of three shock waves, which is illustrated only between two blades in FIG. 2, exists between all of the blades of the cascade. The wave system as described allows great flexibility in design to obtain a wide range of static pressure ratios and exit flow angles from a blade cascade.

Figure 3:
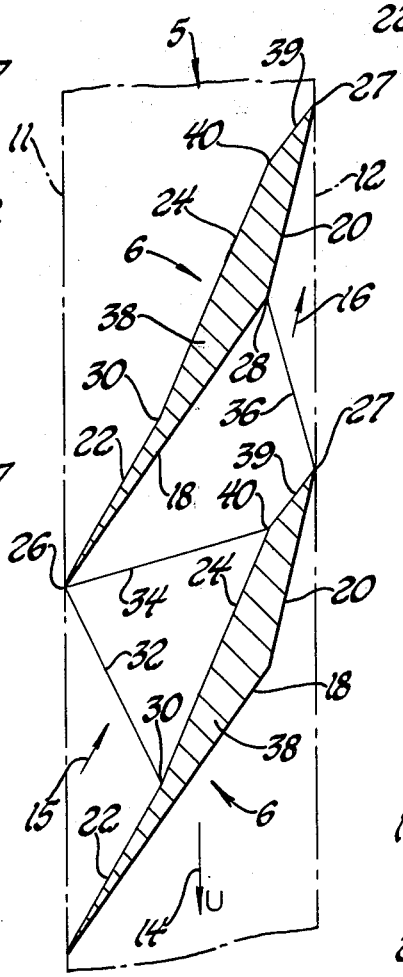
FIG. 3 illustrates a modification of the cascade of FIG. 2 in which the leading edge shock wave is canceled at an edge or line of turning of the surface of the leading blade rather than at its trailing edge.

FIG. 3 illustrates a blade system mostly similar to that of FIG. 2 and, so far as practicable, the same reference numerals will be employed as in FIG. 2 to obviate unnecessary description. The blades 38 of FIG. 3 differ from blades 13 of FIG. 2 by the provision of a third surface 39 on the suction surface of the blade disposed between surface 24 and the trailing edge 27 and joined to surface 24 at an edge 40. The compression wave 32 is generated in the same way as in the previous example and intersects the leading edge of the next blade. The leading edge shock wave, however, instead of intersecting the trailing edge of the leading blade, intersects the leading blade at the edge 40. The turning of the surface at this edge 40 is such that the flow downstream of the wave 34 is parallel to surface 39, and thus the wave is canceled. It is also parallel to surface 18 for two-dimensional flow. The trailing edge shock wave 36 is handled as in the form previously described.

The advantage of the form of FIG. 3 in some cases is the additional blade chord or closer blade setting made possible by the intersection of the leading edge shock wave 34 ahead of the trailing edge of the leading blade rather than at its trailing edge.

Figure 4:
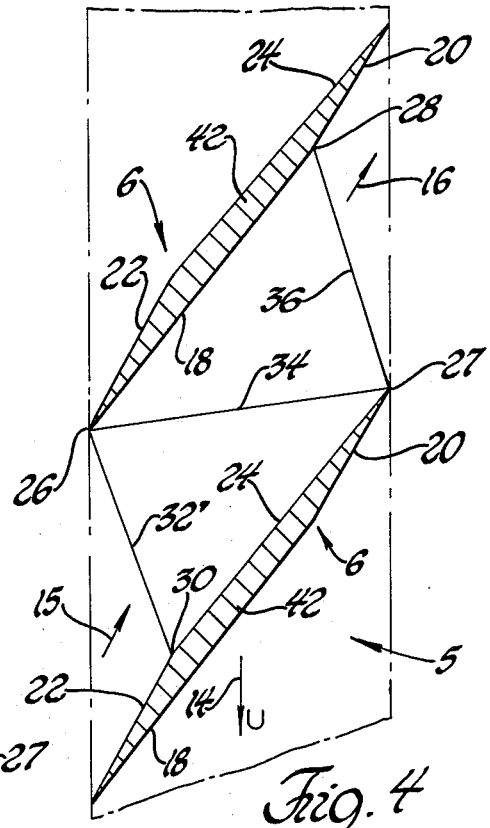
FIG. 4 is a diagram of a blade cascade similar to that of FIG. 2 except that an expansion wave system idealized as a discrete wave is produced on the suction face of the leading blade.

Considering now FIG. 4, the blades 42 of FIG. 4 have four surfaces as in FIG. 2, but the blade is of different cross-section, the obvious difference lying in the fact that the edge 30 defines a convexity rather than a concavity. Therefore, the first wave, indicated as 32' in this case, is an expansion wave system rather than a compression wave. The expansion wave system, idealized as a discrete wave from edge 30, intersects the leading edge 26 of the trailing blade, the leading edge shock wave 34 intersects the trailing edge 27 of the leading blade, and the trailing edge shock wave 36 intersects the trailing blade at the edge 28.

Figure 5:
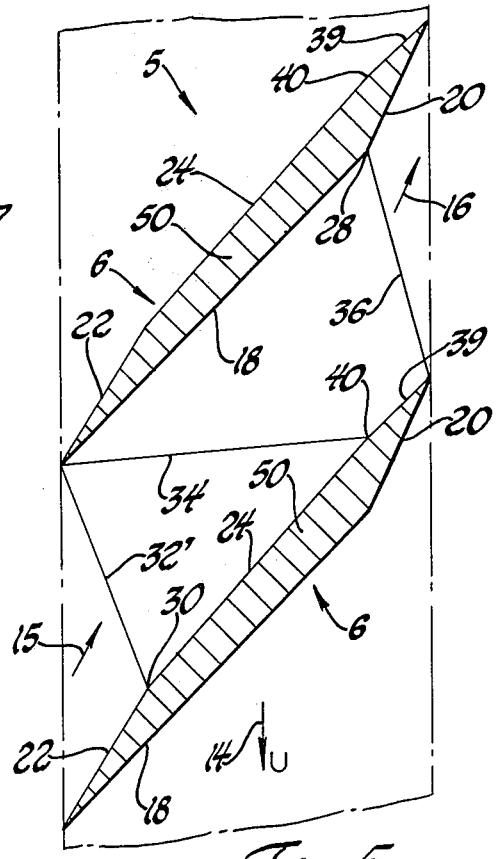
FIG. 5 is a modification of FIG. 4 in which the leading edge shock wave is canceled at an edge in advance of the trailing edge of the leading blade.

The blades 50 of FIG. 5 differ from blades 38 of FIG. 3 in much the same way as the blades of FIG. 4 differ from those of FIG. 2, Here, as in FIG. 3, the blades have five surfaces 18, 20, 22, 24, and 39, but these are differently arranged particularly in that, as in FIG. 4, the edge 30 is convex so that the wave 32' is an expansion wave as in FIG. 4. Wave 34 intersects the edge 40 as in FIG. 3.

As to all forms illustrated, there are two constraints involved. First, the sum of the turning angles of the successive waves must equal the desired turning angle through the cascade. Second, the desired compression of the cascade is composed of the sum of the individual waves.

If particular characteristics of any one wave are adopted, these two constraints establish the characteristics of the two remaining waves.

We do not provide specific examples of dimensions, since the blade cross-section, pitch, and stagger angles must be computed for any particular condition of flow depending upon tangential velocity of the blade, the absolute velocity of the entering air, and the sonic velocity in the air. Also, corrections should be made for bow shock waves, boundary layer phenomena, and flow mixing at exit due to finite blade trailing edge thickness. Such computations are within the range of aerodynamicists skilled in handling problems of supersonic flow.

We believe that the principles and advantages of our invention and the preferred mode of implementing it will be clear to those skilled in the art from the foregoing.

The detailed description of the preferred embodiment of the invention for the purpose of explaining the principles thereof is not to be considered as limiting or restricting the invention, since many modifications may be made by the exercise of skill in the art.

We claim:

1. A compressor rotor blade cascade suited for supersonic gas entry conditions comprising a rotor body of circular cross-section and an annular row of blades extending from the body, the blades being disposed with a substantial stagger angle, each blade having a leading pressure face and a trailing suction face, each blade including a spanwise portion the cross-sections of which are defined by at least four sides each deviating to the extent required from a straight line, the sides meeting at edges defining relatively abrupt changes in the contour of the perimeter of the blade cross-section, two of the said faces being defined by surfaces meeting at the leading edge and two by surfaces meeting at the trailing edge, each face of the blade being defined at least by two such surfaces extending chordwise and spanwise of the blade with adjacent surfaces meeting at a lateral edge extending spanwise of the blade; the blade pitch, the stagger angle, and the cross-section of the blades being such that the wave generated at the edge next downstream from the leading edge on the suction face of each blade intersects the leading edge of the next trailing blade, the leading edge shock wave of each blade intersects an edge of the next leading blade, and the trailing edge shock wave of each blade intersects a lateral edge on the pressure face of the next trailing blade, the faces being so directed downstream from each edge as to accord with the gas flow direction downstream of the waves and cancel the incident waves.

2. A compressor rotor blade cascade suited for supersonic gas entry conditions comprising a rotor body of circular cross-section and an annular row of blades extending from the body, the blades being disposed with a substantial stagger angle, each blade having a leading pressure face and a trailing suction face, each blade including a spanwise portion the cross-sections of which are defined by at least four sides each deviating to the extent required from a straight line, the sides meeting at edges defining relatively abrupt changes in the contour of the perimeter of the blade cross-section, two of the said faces being defined by surfaces meeting at the leading edge and two by surfaces meeting at the trailing edge, each face of the blade being defined at least by two such surfaces extending chordwise and spanwise of the blade with adjacent surfaces meeting at a lateral edge extending spanwise of the blade, the lateral edge on the suction face being concave; the blade pitch, the stagger angle, and the cross-section of the blades being such that the wave generated at the edge next downstream from the leading edge on the suction face of each blade intersects the leading edge of the next trailing blade, the leading edge shock wave of each blade intersects an edge of the next leading blade, and the trailing edge shock wave of each blade intersects a lateral edge on the pressure face of the next trailing blade, the faces being so directed downstream from each edge as to accord with the gas flow direction downstream of the waves and cancel the incident waves.

3. A compressor rotor blade cascade suited for supersonic gas entry conditions comprising a rotor body of circular cross-section and an annular row of blades extending from the body, the blades being disposed with a substantial stagger angle, each blade having a leading pressure face and a trailing suction face, each blade including a spanwise portion the cross-sections of which are defined by at least four sides each deviating to the extent required from a straight line, the sides meeting at edges defining relatively abrupt changes in the contour of the perimeter of the blade cross-section, two of the said faces being defined by surfaces meeting at the leading edge and two by surfaces meeting at the trailing edge, each face of the blade being defined at least by two such surfaces extending chordwise and spanwise of the blade with adjacent surfaces meeting at a lateral edge extending spanwise of the blade, the lateral edge on the suction face being convex; the blade pitch, the stagger angle, and the cross-section of the blades being such that the wave generated at the edge next downstream from the leading edge on the suction face of each blade intersects the leading edge of the next trailing blade, the leading edge shock wave of each blade intersects an edge of the next leading blade, and the trailing edge shock wave of each blade intersects a lateral edge on the pressure face of the next trailing blade, the faces being so directed downstream from each edge as to accord with the gas flow direction downstream of the waves and cancel the incident waves.

4. A compressor rotor blade cascade suited for supersonic gas entry conditions comprising a rotor body of circular cross-section and an annular row of blades extending from the body, the blades being disposed with a substantial stagger angle, each blade having a leading pressure face and a trailing suction face, each blade including a spanwise portion the cross-sections of which are defined by at least four sides each deviating to the extent required from a straight line, the sides meeting at edges defining relatively abrupt changes in the contour of the perimeter of the blade cross-section, two of the said faces being defined by surfaces meeting at the leading edge and two by surfaces meeting at the trailing edge, the leading face of the blade being defined by two such surfaces and the trailing face by three such surfaces, the surfaces extending chordwise and spanwise of the blade with adjacent surfaces meeting at a lateral edge extending spanwise of the blade; the blade pitch, the stagger angle, and the cross-section of the blades being such that the wave generated at the edge next downstream from the leading edge on the suction face of each blade intersects the leading edge of the next trailing blade, the leading edge shock wave of each blade intersects a lateral edge of the suction face of the next leading blade, and the trailing edge shock wave of each blade intersects a lateral edge on the pressure face of the next trailing blade, the faces being so directed downstream from each edge as to accord with the gas flow direction downstream of the waves and cancel the incident waves.

5. A cascade as defined in claim 4 in which the edge next downstream from the leading edge on the suction face of each blade is concave.

6. A cascade as defined in claim 4 in which the edge next downstream from the leading edge on the suction face of each blade is convex.

* * * * *